US006189715B1

(12) United States Patent
Dubois

(10) Patent No.: US 6,189,715 B1
(45) Date of Patent: Feb. 20, 2001

(54) SNIFTER FOR ALCOHOLIC BEVERAGES SUCH AS BRANDY, SPIRITS AND LIQUORS

(76) Inventor: Aimé Dubois, 42b, Avenues des Sapins, 10800 Saint Julien-les-Villas (FR)

( * ) Notice: Under 35 U.S.C. 154(b), the term of this patent shall be extended for 0 days.

(21) Appl. No.: 09/171,157

(22) PCT Filed: Apr. 11, 1997

(86) PCT No.: PCT/FR97/00651

§ 371 Date: Mar. 2, 1999

§ 102(e) Date: Mar. 2, 1999

(87) PCT Pub. No.: WO97/37571

PCT Pub. Date: Oct. 16, 1997

(30) Foreign Application Priority Data

Apr. 11, 1996 (FR) ..... 96 04700

(51) Int. Cl.[7] ..... A47G 19/22
(52) U.S. Cl. ..... 215/374; 215/377
(58) Field of Search ..... 215/371, 374, 215/377, 365, DIG. 7; D9/537

(56) References Cited

U.S. PATENT DOCUMENTS

| | | | | |
|---|---|---|---|---|
| D. 77,943 | * | 3/1929 | Dougherty | D7/537 |
| D. 278,401 | * | 4/1985 | Assez | D7/537 |
| D. 317,101 | * | 5/1991 | Wenzl | D7/537 |
| D. 370,155 | * | 5/1996 | Harrison et al. | D7/537 X |
| 809,567 | * | 1/1906 | Henckel | 215/377 |
| 2,142,811 | * | 1/1939 | Agonis | 65/13 |
| 2,203,647 | * | 6/1940 | Cunningham et al. | 215/374 |
| 2,374,092 | * | 4/1945 | Glaser | 215/DIG. 7 X |
| 2,543,427 | * | 2/1951 | Warne | 215/DIG. 7 X |
| 3,792,988 | * | 2/1974 | Nowak et al. | 215/374 X |
| 4,681,236 | * | 7/1987 | Ilk | 215/374 |
| 5,513,764 | * | 5/1996 | Harrison et al. | 215/377 X |

FOREIGN PATENT DOCUMENTS

| | | | | |
|---|---|---|---|---|
| 348669 | * | 2/1928 | (BE) . | |
| 428043 | * | 5/1938 | (BE) . | |
| 817207 | * | 12/1956 | (DE) | 215/374 |
| 7819661 | * | 10/1978 | (DE) . | |
| 3227303 | * | 2/1984 | (DE) | 215/374 |
| 400358 | * | 12/1990 | (EP) | 215/371 |
| 2641960 | * | 7/1970 | (FR) | 215/274 |
| 556500 | * | 7/1973 | (FR) | 215/374 |
| 2581355 | * | 11/1976 | (FR) . | |
| 2648340 | * | 12/1990 | (FR) | 215/374 |
| 2864534 | * | 6/1993 | (FR) . | |
| 2700257 | * | 7/1994 | (FR) . | |

* cited by examiner

*Primary Examiner*—Sue A. Weaver
(74) *Attorney, Agent, or Firm*—Harrison & Egbert

(57) ABSTRACT

A snifter for alcoholic beverages such as brandy, spirits and liquors including a glass having a softly flared container (1), with a bowl (2) extending therefrom and including two parts, a first lower part (20) flaring more sharply, extended by a second, higher part (21) gradually tapering up to the drinking lip (22), the opening of the latter defining a surface equal to or larger than that defined by the upper edge (10) of the container (1), which is the recommended filling limit.

5 Claims, 4 Drawing Sheets

SNIFTER FOR ALCOHOLIC BEVERAGES SUCH AS BRANDY, SPIRITS AND LIQUORS

BACKGROUND OF THE INVENTION (1) Field of the Invention

This invention relates to a glass for tasting alcohols such as brandies, spirits and liquors.

Tasting consists in appreciating the olfactory and gustatory values of an alcohol or other alcoholic drinks.

(2) Description of the Prior Art

There are already known different kinds of tasting glasses; they generally include a foot topped with a stem that supports the bowl that comprises a first portion widening upwards, then a second portion narrowing towards the upper edge, called a lip.

This is the case of the glasses described in FR-A-2,648,340 and FR-A-2,684,534, which are however more particularly aimed at tasting wines.

On the other hand, these glasses are so designed that the taster can mechanically accelerate the evaporation of the product to be tasted, by applying a gyratory motion to the glass, which, in the case of a alcohol, has a drawback as regards the olfactory appreciation, for shaking favors the release of esters that the nose when sniffing the product.

From BE-A-428 043 is also known a glass having on the lower side a portion slightly widened in the shape of a truncated cone and topped with a portion, called bulge, which largely widens, then narrows towards the lip, the inner diameter of this latter being larger than the largest outer diameter of said portion in the shape of a truncated cone. The aim of the features of this glass is an easy piling up, but they do not allow the tasting, because of the small volume of the bulge that cannot be assimilated with a bowl.

SUMMARY OF THE INVENTION

The aim of this invention is to provide a glass for tasting alcohols that allows a full olfactory appreciation.

Thus, this invention relates to a glass for tasting alcohols such as brandies, spirits and liquors, comprising a slowly widening container at the upper edge of which begins a bowl, this latter comprising two portions, a first portion of a small height, which widens to a larger extent and is extended by a second portion of a large height, which progressively narrows towards the lip the opening of which delimits a surface at least equal to the one defined by the upper edge of the container, which edge forms the recommended filling limit, the volume of this parison being larger than that of the container.

According to another, additional feature of the glass according to the invention, this latter includes a foot topped with a stem supporting the container.

During the filling, the liquid is directly poured into the container, the recommended maximum level for a maximum exhalation of the aromas, without circular shaking, being situated at the filling edge of the container, the surface area of the liquid then being smaller or at most equal to the surface area defined by the lip opening.

The features of the glass according to the invention allow to keep under control the emanations of esters through the evaporation surface of the alcoholic liquid the container is filled with. During sniffing, the aromatic molecules, which fill up the volume formed by the bowl, release their original substances at the arrival of the air from outside.

The glass forming the object of this invention allows a complete exhalation of the primary, secondary and tertiary aromas of the liquid to be tasted, with the reservation of the aggressive emanations of the alcohol supporting the organoleptic molecules and the volatile substances.

The taster can finally appreciate the gustatory value of the liquid by bringing the glass in a traditional way to his lips or, preferably, by sucking the liquid into his mouth by means of a straw of a small diameter immersed into the container, in order to preserve the above-mentioned olfactive tasting.

The advantages and the features of this invention will clearly appear from the following description, with reference to the attached drawing that shows several non-exhaustive embodiments of same.

DESCRIPTION OF THE PREFERRED EMBODIMENTS

Figure 1:
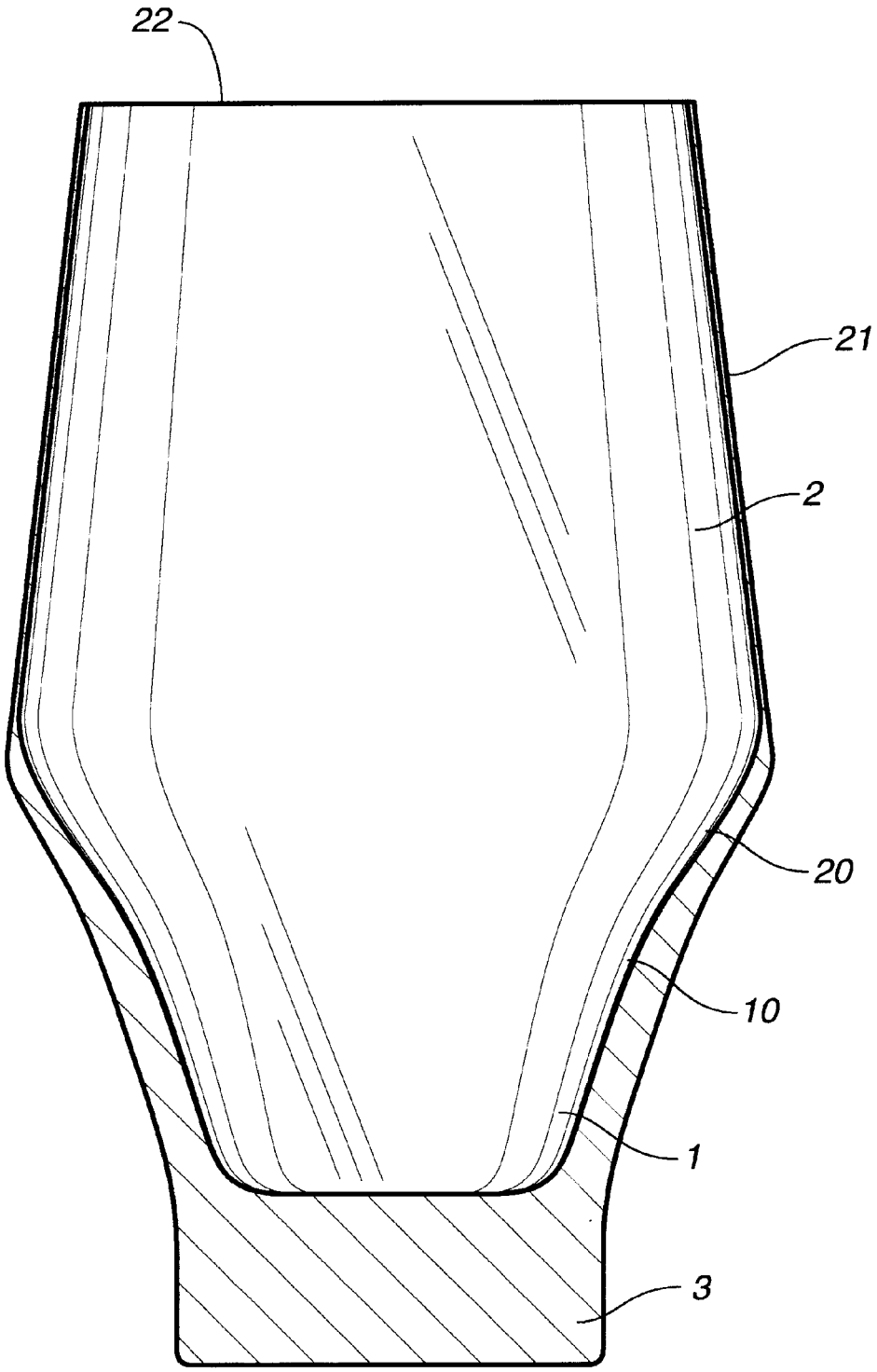
FIG. 1 shows a cross-sectional view according to a median vertical plane of a first embodiment of the tasting glass according to the invention.

When referring to FIG. 1, one can see that according to a first embodiment a tasting glass according to the invention includes, from the bottom to the top, a container 1 slowly widening towards its upper edge 10 at which begins the bowl 2 that includes two portions, a first portion 20 of a small height and a quickly increasing width, and a second portion 21 of a large height and a width progressively decreasing towards the lip 22.

The surface area defined by the lip 22 is larger than the surface area defined by the upper edge 10 of the container 1, which forms the filling limit that may be indicated by a mark.

The aromas and the heavy molecules of the liquid to be tasted stagnate in portion 20 of the bowl and they release their original substances in portion 21 at the interface with the air entering into it through the lip 22 during sniffing.

One should note that the glass includes at the lower side, under the container 1, a solid portion 3 of a certain height allowing the user to grab it. The glass shown is used for tasting alcohols such as whisky.

The surface area ration may reach up to 3.5, which allows, for those who do wish so, to dilute the alcoholic liquid with a neutral liquid, e.g. water, so that the mixture fills up the container and part of portion 20, so that the reduction in alcohol and aroma densities be compensated for by an increase of the evaporation surface, which should remain smaller than the surface area defined by the lip 22.

Figure 2:
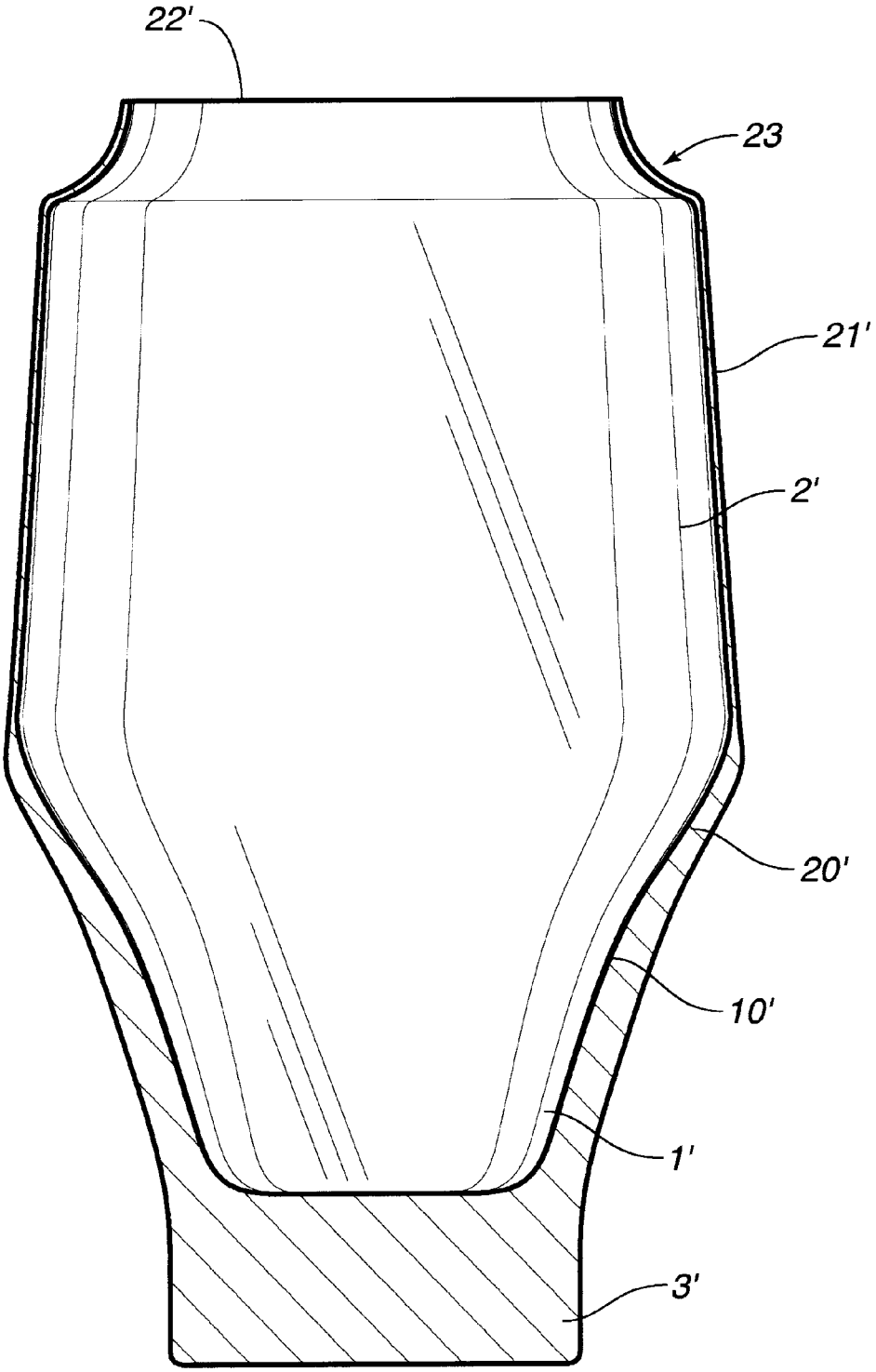
FIG. 2 shows a cross-sectional view according to a median vertical plane of a variant of the same glass.

When referring to FIG. 2, one can see that the upper portion of the bowl 2', at the level of the lip 22', includes a re-entrant rim 23 of a concave shape, which narrows the opening of the lip 22'.

This embodiment allows one to taste a whisky cooled down by means of one or several ice cubes; the cooling down of the alcoholic liquid reduces the emanations; the narrowing of the lip thus allows, while maintaining the ration between the opening of the lip 22' and the liquid surface exposed to the air, to increase the retention of the emanations.

One should note that the rim 23 advantageously retains the ice cube or cubes, or the eventual crust when the glass is taken to the mouth.

Figure 3:
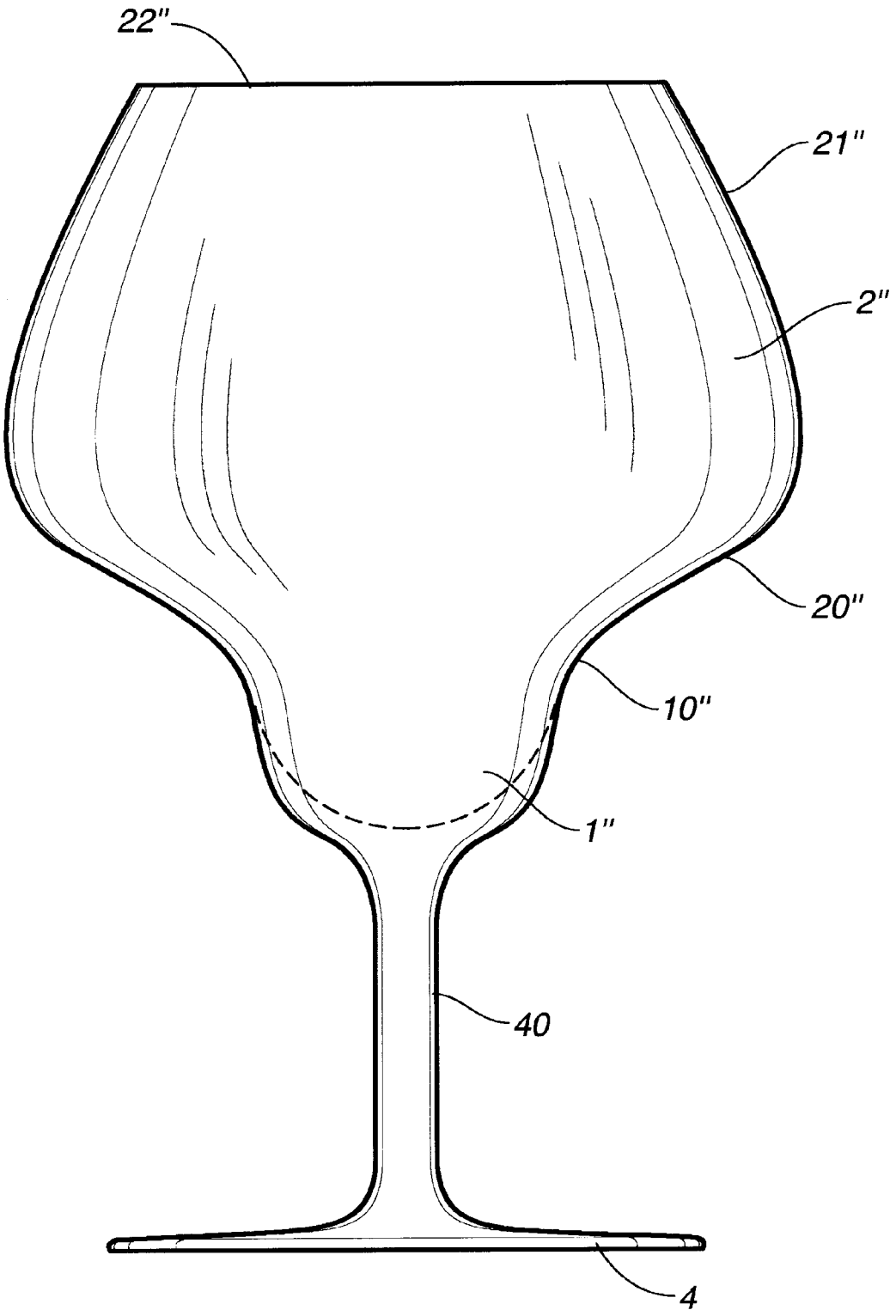
FIG. 3 shows an elevational view of a second embodiment of the tasting glass according to the invention.
Figure 5:
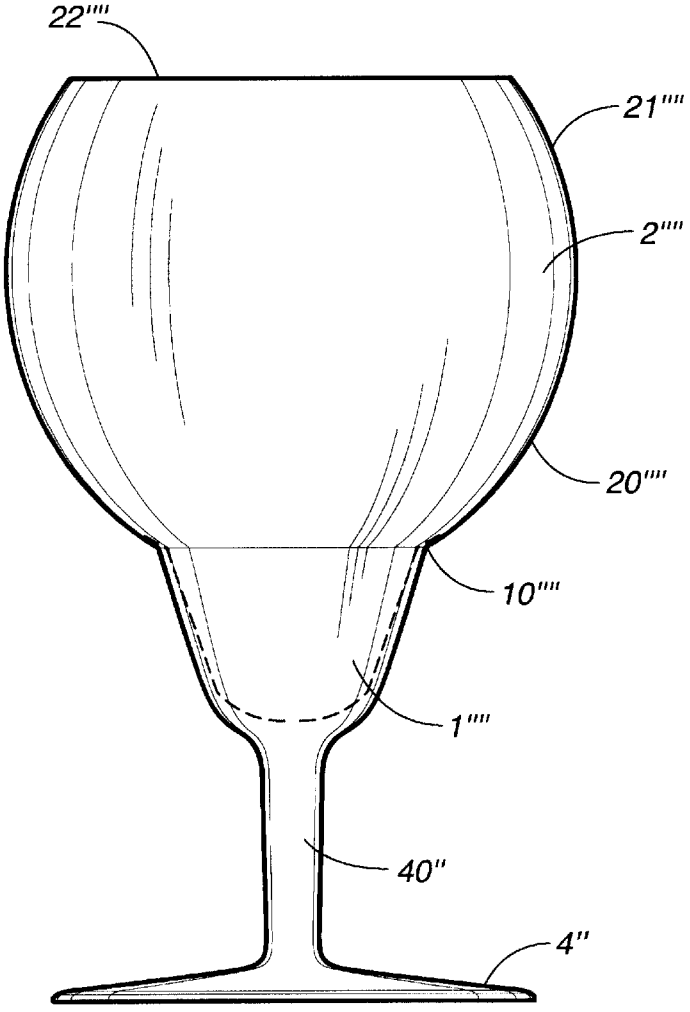
FIGS. 4 and 5 show variants of this same tasting glass.

When referring now to FIG. 3, one can see that, according to a another embodiment, the tasting glass according to the invention includes a foot 4 and a stem 40 and that the portion 21' of the bowl 2' has a curved shape.

Figure 4:
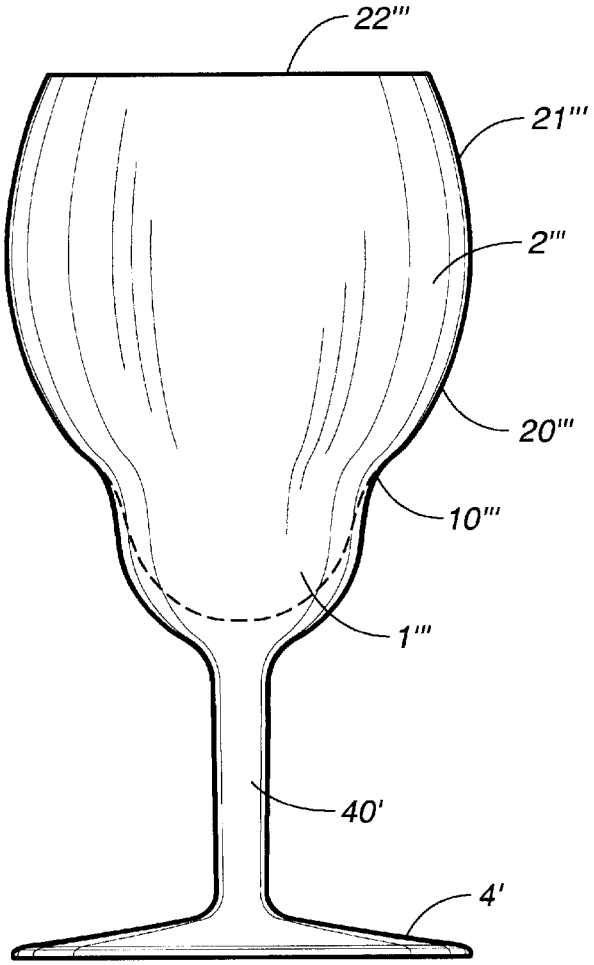

When referring to FIGS. 3 and 4, one can see two variants of the tasting glass according to the invention that show that the shape and the volume of the container 1" and 1'", on the one hand, and of the bowls 2" and 2'", on the other hand, have no effect on the exhalation of the aromas, provided the ratio between the opening of the lip 22" and 22'" and the liquid surface exposed to the air is maintained.

What is claimed is:

1. A glass for tasting brandies, spirits and liquors comprising:

a container having a base and an upper portion, said upper portion widening outwardly from said base; and a bowl connected to and extending from an upper edge of said upper portion of said container, said bowl comprising a first portion and a second portion, said first portion having a lesser height than said second portion, said first portion widening so as to have a diameter greater than a diameter of said upper edge of said container, said second portion progressively and continuously narrowing upwardly form said first portion toward a lip at a top thereof, said lip defining an area in a horizontal plane no less than an area in a horizontal plane defined by said upper edge of said container, said bowl having a volume greater than a volume of said container, said upper edge of said container defining a desired limit for filling the glass, said area defined by said lip being up to 3.5 times said area defined by said upper edge.

2. The glass of claim 1, said second portion of said bowl having a re-entrant rim of a concave shape extending inwardly toward said lip.

3. The glass of claim 1, said base of said container having a solid portion with a height suitable for grasping by a human hand.

4. The glass of claim 1, said base comprising a stem supported upon a foot, said stem being connected to said upper portion.

5. The glass of claim 1, further comprising:

a liquid selected form the group consisting of a brandy, a spirit and a liquor, said liquid received in said container to a level no higher than said upper edge of said container.

* * * * *